United States Patent [19]

Moller

[11] 4,424,882

[45] Jan. 10, 1984

[54] RESONATOR TYPE MUFFLERS

[76] Inventor: Paul S. Moller, 9350 Curry Rd., Dixon, Calif. 95620

[21] Appl. No.: 284,984

[22] Filed: Jul. 20, 1981

Related U.S. Application Data

[63] Continuation-in-part of Ser. No. 232,816, Feb. 9, 1981, abandoned.

[51] Int. Cl.[3] ..... F01N 1/08

[52] U.S. Cl. ..... 181/231; 181/268; 181/272; 181/275

[58] Field of Search ..... 181/230, 231, 268, 272, 181/275, 282; 55/276

[56] References Cited

U.S. PATENT DOCUMENTS

| | | | |
|---|---|---|---|
| 2,150,768 | 3/1939 | Hedrick | 181/275 |
| 2,993,559 | 7/1961 | Everett | 181/268 |
| 4,113,051 | 9/1978 | Moller | 181/268 X |
| 4,192,402 | 3/1980 | Nakagawa et al. | 181/272 X |
| 4,203,503 | 5/1980 | Franco et al. | 181/272 |
| 4,209,076 | 6/1980 | Franco et al. | 181/272 |

FOREIGN PATENT DOCUMENTS

| | | | |
|---|---|---|---|
| 872105 | 5/1942 | France | 181/272 |

*Primary Examiner*—Thomas H. Tarcza
*Attorney, Agent, or Firm*—Owen, Wickersham & Erickson

[57] ABSTRACT

Resonator type mufflers of this invention utilize multiple chambers with inductor tubes between the chambers, and specific size and spatial relationships among the tubes and chambers. In one form of muffler suitable for industrial applications or vehicular use, elongated inductor tubes passing from one chamber to a second chamber have downstream ends spaced about ¾ inch from the end wall of the second chamber, which has a central opening with area at least as large as the combined areas of the inductor tubes. For industrial mufflers which are required to be short, there is only one set of coextensively positioned inductor tubes, but for longer mufflers as on motorcycles, an elongated primary inductor preferably is used in addition, as a primary resonator stage. In another embodiment of a muffler particularly for motorcycles, first and second inductor tubes overlap within a second chamber in a particular space-saving arrangement, which also lends itself to muffler core replacement in housings of generally standard configuration.

38 Claims, 7 Drawing Figures

RESONATOR TYPE MUFFLERS

This application is a continuation-in-part of Ser. No. 232,816, filed Feb. 9, 1981, abandoned.

BACKGROUND OF THE INVENTION

The invention relates to reactive mufflers for internal combustion engines, and more particularly to an improved, compact resonator type muffler which creates relatively little back pressure with a high degree of noise attenuation.

Resonator type mufflers are well known. Typically tubes, called inductor tubes, have extended within a housing between two resonating chambers, with some reflection and reversal of the direction of travel as in a baffle. In the process, noise is attenuated. However, the actual physical mechanism of noise attenuation in these resonator type mufflers has not been completely understood. Precise analysis of noise attenuation of the various frequency ranges in a resonator muffler is almost impossible because the superimposed air stream has an enormous and complex effect on the results.

The diameter and length of the inductor tube together with the dimensions of the chambers determine to a large extent the frequencies that will be attenuated, i.e., small chambers and short tubes are more likely to attenuate the higher frequencies. The degree of noise attenuation (reduction in dB(A) level) at a particular frequency is influenced by the acoustical characteristics of the inductor tube. High acoustical inductance, using small tubes, has meant a high gas velocity leading to a large pressure loss, since the kinetic energy associated with this gas velocity is lost as the gas exits the tubes.

In a typical motorcycle and in some automotive designs it has been desirable for the required internal volumes to be generated by length rather than diameter. In particular on most motorcycles the chambers have been very narrow and megaphone shaped for esthetic reasons. In the past these attractive megaphone shaped mufflers have used a "glass pack" design (using fiberglass for acoustical dissipation). Since this amounted to wrapping fiberglass around a perforated straight through core, the narrow design was easy to work with. Previous resonator designs for motorcycles, on the other hand, were severely restrictive to the flow. Historically, therefore the "glass packs" have enjoyed a performance reputation while the more noise effective resonator types have been passed by.

There has always been a need for mufflers of compact design and maximum noise attenuation with a minimum of back pressure imposed on the engine. These needs have been particularly acute in the field of motorcycle noise reduction and also industrial engines. The space criteria for industrial engines are generally somewhat different from those for motorcycles, usually requiring shortness of length to avoid too much protrusion from the engine.

It is among the objects of the present invention to improve noise attenuation capability in a resonator type muffler while keeping back pressure unusually low and space requirements to a minimum.

SUMMARY OF THE INVENTION

The present invention improves upon former resonator muffler designs in several important respects. Back pressure is substantially reduced, approximating that of "glass pack" designs. Noise at 1000 cps and above is attenuated almost completely, with a seemingly simple arrangement of inductor tubes and resonator chambers. Lower frequencies are attenuated significantly, and mufflers of the invention are compact and inexpensively produced.

In a first embodiment, inductor tubes extending between first and second chambers in a housing are so located with respect to an end wall of the second chamber as to cancel out nearly all sound at 1000 cps and above. The inductor tubes also significantly attenuate lower frequencies, and the result is an industrial muffler that may be quite short in length, with a single stage of inductor tubes.

The muffler of this design may be made longer, with three chambers and two stages of resonator tubes, for long, narrow applications such as motorcycles.

Accordingly, one embodiment of a resonator type muffler for an internal combustion engine comprises an elongated housing having an inlet and an outlet, with a chamber divider extending generally transversely across the interior of the housing to define a first chamber in communication with the housing's inlet, upstream of the divider, and a second chamber downstream of the divider. At least one high frequency inductor tube extends longitudinally in the housing through the chamber divider, with an inlet end in the first chamber and an outlet extending into the second chamber. At the downstream end of the second chamber is a wall with an opening, and the outlet end of the inductor tube is spaced from the wall by a distance of about ½ inch to 1 inch, and is offset from the wall opening.

For the industrial muffler at least two similar inductor tubes are arranged coextensively, and the first chamber is immediately adjacent to the housing's inlet. If the muffler is configured as a motorcycle muffler, an additional, primary chamber is included upstream of the first chamber, and a primary stage of induction is included in the form of at least one primary inductor tube extending between the primary chamber and the first chamber.

The area of the opening in the downstream end wall of the second chamber should be at least equal to the sum of the areas of the high frequency inductor tubes, i.e. the inductor tubes entering into the adjacent second chamber.

Mufflers of the invention may include a spark arrestor at the downstream end, in communication with the wall opening at the end of the second chamber.

In another embodiment of a muffler according to the invention has an elongated, tapered housing with an inlet and an outlet and with a chamber divider separating the housing into first and second chambers. At least one primary inductor tube extends longitudinally through the divider, from the first chamber to the second. A secondary inductor tube is downstream of the primary tube or tubes in the second chamber, in overlapping relationship and connected to each primary tube so that the tubes form a rigid unit. The secondary inductor tube extends to an opening in an end wall of the second chamber.

The secondary inductor tube in this form of the invention preferably is tapered from its upstream end to its downstream end, and there may be a spark arrestor at the end of the housing, just downstream of the secondary tube. One feature that enhances compactness and simplicity in this unique design is that the primary tubes and secondary tube, in their overlapping connection area, may be deformed and compacted together, so that the inlet end of the secondary tube is of elongated, oblong cross-sectional shape to accommodate the primary inductor tubes. The shape of the secondary tube still is such that it increases in cross-sectional area as it progresses downstream.

The overlapping tubes and downstream end wall preferably are formed into a rigid unit, as by welding, and this unit has wide application as a replacement core for standard size motorcycle muffler housings. The chamber divider is slip-fitted over the upstream primary inductor tubes (there preferably are two), retained thereon with spring clips. When the tubes are inserted into the tapered muffler housing, from the downstream end, the chamber divider wedges against the housing at the point where the diameters match. Then the tubes are pushed or driven further upstream, with slippage of the tubes in the chamber divider, until the downstream end wall plate reaches the end of the housing, for connection at that location.

This form of muffler therefore has the multiple advantages of good noise attenuation, low back pressure, compactness and versatility as a replacement muffler "core" for various shapes of existing megaphones, or muffler shells.

Other objects, advantages and features of the invention will be apparent from the following description of the preferred embodiments, considered along with the accompanying drawings.

DESCRIPTION OF THE PREFERRED EMBODIMENTS

Figure 1:
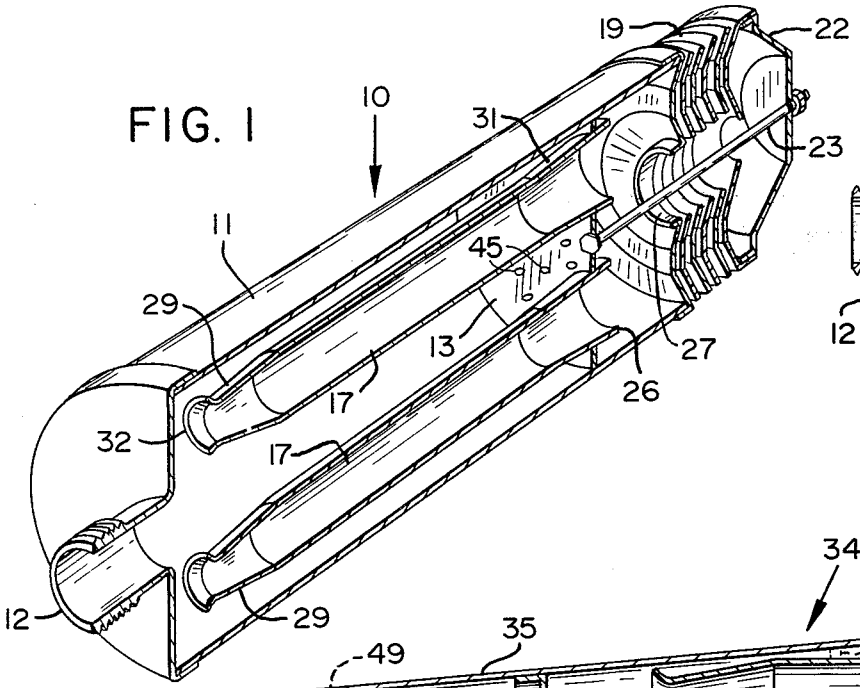
FIG. 1 is a perspective view showing an industrial type muffler of short, wide configuration embodying the invention.

In the drawings, FIG. 1 shows in partially broken-away perspective a muffler according the the invention 10 having short, wide configuration as is often mandated in industrial applications. The muffler 10 comprises an outer shell 11, an inlet 12 which may be screw threaded for a particular industrial application, a chamber divider plate 13 dividing the interior of the muffler into upstream and downstream chambers 14 and 16, respectively, and a pair of inductor tubes 17 extending between the upstream and downstream chambers 14 and 16 to form a resonator. At the downstream end of the muffler 10 may be a spark arrestor 18, as is required in many applications.

Figure 2:
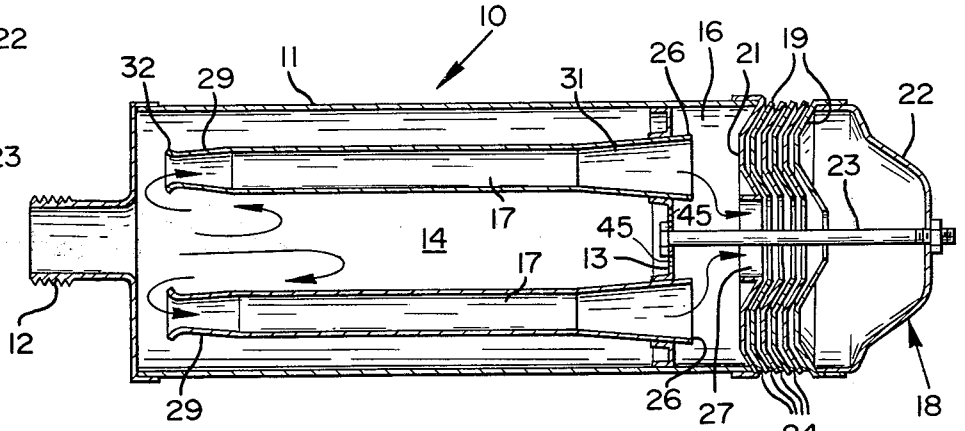
FIG. 2 is a longitudinal sectional view of the muffler of this embodiment.
Figure 6:
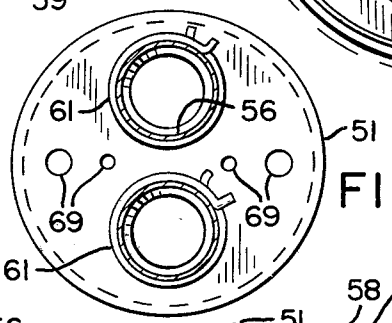
FIG. 6 is a sectional view taken along the line 6—6 of FIG. 5.

FIG. 2 shows the muffler assembly 10 in longitudinal cross section. The spark arrestor 18 at the downstream end of the muffler may be made up of a series of generally cup-shaped, annular discs 19 generally of the type disclosed by U.S. Pat. No. 3,987,867 (FIG. 6), with a special upstream end cup member 21 adapted to fit over the downstream end of the muffler shell or housing 11. At the downstream end of the spark arrestor 18 is a cup-shaped end 22, as shown. The cup-shaped end 22 and the stack of spark arrestor discs 19 may be retained together on the end of the muffler 10 by a through bolt 23, drawing the end member 22 toward the chamber divider 13 as indicated. Gases bouncing off the inside surface of the end cup 22 are exhausted through the spaces between the series of cup-shaped discs 19. To keep the discs spaced apart, they may be deformed at their outer edges at aligned locations, as shown at 24. The deformations 24 occur at at least three preferably equally spaced locations around each disc, so that the discs stack in preselected alignment upon assembly.

The dimensions of the muffler shell 10 may be, for example, approximately 5 inches in diameter and 6 inches long. However, the most important dimension of the muffler 10 shown in FIGS. 1 and 2 is the distance between the downstream ends 26 of the inductor tubes 17 and the end wall of the second chamber 16, formed by the farthest upstream disc member 21. This distance, for optimum noise reduction for noise above 1000 cps and for most noise at 1000 cps must be between about ½ inch and 1 inch. Preferably, the distance is approximately ¾ inch. The downstream ends 26 of the tubes 17 may extend beyond the divider plate 13 by about ¼ inch, so that the chamber divider 13 is spaced about 1 inch from the disc or end wall 21.

Another important feature cooperative with the spacing discussed above is the positioning of the inductor tubes relative to the central opening 27 of the upstream disc or end wall 21. The inductor tubes 17 are positioned outwardly from the central axis of the muffler 10, toward the muffler shell 11, so that they are offset from the opening 27 in the end wall 21 as indicated. Preferably the downstream ends 26 of the inductor tubes are entirely outside the circular projection of the opening 27. This relationship is important in the sound wave reflective process that is believed to be responsible for the surprising level of noise reduction that results from this resonator muffler configuration. It is believed that the reflective process generated by this configuration is responsible for the dramatic noise reduction in that compression waves leaving the inductor tubes 17 are partially reflected off the end of the tubes 17, back upstream in the tubes as opposite sign expansion waves, while the remaining waves or remainder of each wave exits the tubes to impinge on the end wall 21 of the downstream chamber 16, returning upstream as a like sign (compression) wave. A strong compression wave travels somewhat faster than an expansion wave, so that a reflected compression wave apparently overtakes a reflective expansion wave. Therefore by expanding one wave into two opposite sign waves and then having the waves recombine again in the inductor tube, a process of noise elimination results.

Interestingly, it has been found that when the inductor tubes 17 are made longer, the gap or separation between the tube ends 26 and the end wall 21 can be slightly larger. This seems consistent with the theory that waves are divided into opposite signs and ultimately cancel each other out.

It has also been found that the area of the opening 27 in the downstream chamber end wall 21 must be at least equal to the total exit area of the inductor tubes 17. This, in conjunction with the fact that the distance between the chamber divider 13 and the end wall 21 may be critical suggests that the inductor tube ends may be one reflective surface with the chamber end 21 the other, and that it is desirable that there be no other acoustical reflective surface within close proximity to the inductor tube exits 26. Another reflective surface would exist, for example, in the case where the opening 27 is acoustically restrictive, by reduced area, even if it did not restrict the flow of exhaust gases.

The shape of the downstream end 26 and also the upstream ends 29 of the inductor tubes is also important in this noise reduction system of the invention. Each end should be flared or tapered from a smaller area of diameter to a larger area of diameter in the downstream direction, as indicated in the drawings. These tapers 31 and 29 are flow diffusers which allow a large acoustical inductance to be achieved with comparatively small flow resistance, since kinetic energy of the flowing gases is recovered as the flow is slowed in the diffuser. This is important particularly at the downstream ends 26, where the diffusers 21 provide for maintenance of the kinetic energy of the flowing gases as they exit the tubes 17 and enter the downstream chamber 16.

A very important effect of the inlet end diffuser 29 is that, through the provision of a change in cross sectional area at the end of the tube, they can cause wave reflection to occur in such a way that cancellation of sound waves takes place in the tube.

Compression waves reflect as expansion waves off the open end of a tube in which they are moving. The change in cross sectional area associated with the inlet end diffuser 29, which appears as an expansion wave when viewed from the upstream end, reflects a wave of like sign back downstream in the tube at a time when it can react favorably with wave patterns already existing in a mid-frequency range (300 cps to 1500 cps).

Normally, reflection of waves off the end of the inductor tubes, and reflections within the chambers, will move the acoustical energy from the lower frequencies (60 to 300 cps) to the higher frequencies. By introducing a cross sectional change in the tube at the appropriate point it is possible to provide conflicting wave patterns that act as a barrier to this transfer process. This is done by using the cross section change to reflect part of the upstream moving wave in the tube as a like sign wave (i.e., compression wave as a compression wave). The remainder of the upstream moving wave, reflecting off the open end of the tube, will be reflected downstream as an opposite sign wave.

Thus it is possible in introduce a superimposed cancellation process that could be expected to work well at a particular frequency. If that frequency corresponds with the firing frequency of the engine, then in effect a barrier to the transfer process is created.

In practice, it appears that the engine firing frequency over which this effect is significant is quite broad. For a configuration tested, the resulting frequency analysis showed no significant benefit below 250 cps but provided a major effect at 500 to 1000 cps. Significant noise reduction occurred above 1000 cps because the removal of acoustical energy at 500 cps reduced the energy available to be transferred to the higher frequencies. Any reflective process, inherent in all resonator muffler designs, will undergo this upward transfer of acoustical energies.

FIG. 2 also illustrates that each inductor tube 17 preferably includes a sharp flare or bell mouth 32 at its extreme upstream end, extending from the end of the flare 29 as illustrated. This provides for the inductor tubes 17 to efficiently receive gases which have entered the upstream chamber 14 from the inlet 12 as indicated by the arrows in FIG. 2.

In operation, the industrial type muffler configuration shown in FIGS. 1 and 2 receives exhaust gases and sound energy through the inlet 12. Most of the sound energy is first reflected off the chamber divider 13 at the downstream end of the first or upstream chamber 14. This moves some of the noise to higher frequency. This sound energy, and the gases, enter the inductor tube 17 through the bell mouths and upstream diffusers or tapers 29. These inductor tubes 17 are relatively long and therefore provide good noise attenuation at the lower frequencies, approximately 125 to 500 cps. The specific spatial arrangement between the downstream ends 26 of the inductor tubes and the end wall 21, and among the chamber divider 13, tube ends 26 and end wall 21 provides the very thorough attenuation of the higher frequencies, 1000 cps and above. As discussed above, part of the sound wave energy travelling to the ends of the tubes 17 is reflected off the open end of each tube and travels back upstream as a wave of opposite sign. Most of the remainder exits the tubes and is reflected off the downstream chamber end wall 21, part of this reflective energy also travelling back upstream into the tubes 17. As explained previously, the compression waves reflected off the end wall 21 and re-entering the tubes travel slightly faster than the remaining components of the waves, i.e. the expansion waves reflected off the open end of the tubes 17, and a cancellation is believed to occur. Similarly, as outlined above, some of the upstream-travelling energy, upon reaching the upstream end of the tubes, is broken down in the reflection process into opposite sign waves reflected back downstream off the open end, and like sign waves reflected back by the change in area, the narrowing of the tube's cross section in the diffuser 29. Again, a cancellation is believed to take place to this effect.

As noted earlier, the exhaust gas stream, at various velocities, is superimposed over these wave phenomena, making analysis much more difficult. The gases, after exiting the inductor tubes 17, move centrally in the downstream chamber 16 and pass through the opening 27 in the end wall or disc 21, then reverse direction in the spark arrestor 18 and pass to the atmosphere through the spaces between the discs 19. Meanwhile, any sparks passing through the muffler are caught in the end cup 23 of the spark arrestor as the direction of flow reverses.

The noise exiting the muffler 10 is very significantly attenuated, particularly at the higher or more annoying frequencies. This is accomplished with very little back pressure.

Figure 3:
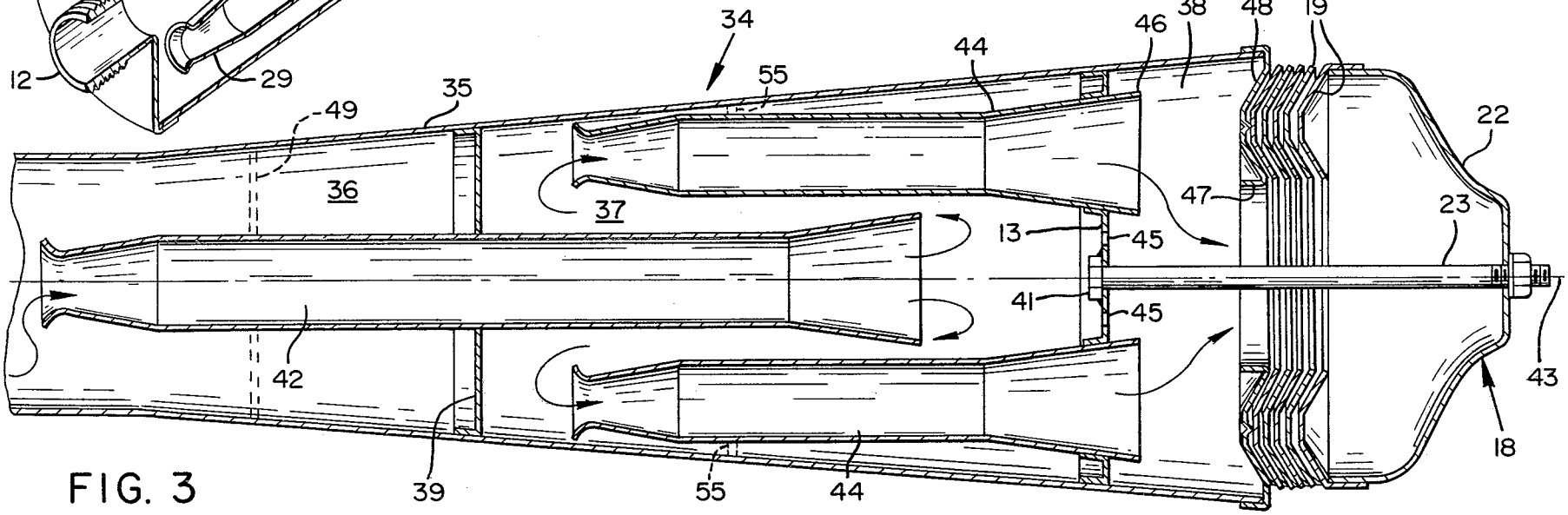
FIG. 3 is a longitudinal sectional view showing another form of a muffler following the same principles as the muffler of FIGS. 1 and 2, but of long narrow configuration as for use on motorcycles.

FIG. 3 shows another form of muffler 34 according to the invention, employing the same principles as the muffler shown in FIGS. 1 and 2. The muffler of FIG. 3 is more adapted to use on a motorcycle or even an automobile, where a long, narrow configuration is needed. In this design, an elongated and preferably tapered megaphone or muffler shell 35 is divided into three successive resonating chambers 36, 37 and 38 by chamber dividers 39 and 41.

The middle and downstream chambers 37 and 38 of the muffler 34 are generally analogous to the first and second chambers 14 and 16 of the industrial type muffler shown in FIG. 2, respectively. Therefore, they will be referred to herein and in the appended claims as first and second chambers, for the sake of consistency, while the farthest upstream chamber 36 will be referred to as the primary chamber.

In this form of muffler, two stages of inductor tubes are included: a first or primary inductor tube 42, centrally located as shown (or a plurality of such tubes, equally spaced away from the central axis 43 of the muffler), and a secondary stage of tubes 44, which may be called high frequency inductor tubes. There are preferably at least two of these high frequency inductor tubes 44, spaced outward from the central axis 43 and with their downstream ends 46 outside the projections of a central opening 47 in an end wall 48 of the downstream or second chamber 38, as in the muffler shown in FIG. 2.

There is also preferably included a spark arrestor 18 similar to that shown in FIGS. 1 and 2.

For the upstream or primary stage of induction tubes, a single inductor tube 41 is preferable for ease of manufacturing in this type of elongated muffler. This single inductor tube 42 can be made quite long, and as such it does a better job of attenuating noise at the lower frequencies, while the high frequency inductor tubes 44 take care of the noise at 1000 cps and above, primarily due to the specific spatial arrangement between the downstream ends 46 of the tubes 44 and the end wall 48 of the downstream chamber 38, the same as described above in connection with the first form of muffler 10.

The elongated muffler 34 is preferably of welded construction, with the chamber dividers 39 and 41 welded to the interior wall of the muffler shell 35 and to the inductor tubes 42 and 44. Struts as indicated at 49 and 51 may be included to stabilize the inductor tubes within the shell, indicated in dashed lines in FIG. 3 to show that they do not constitute walls which would block the flow of gases and noise energy.

The end wall 48 is retained to the muffler shell 35 preferably via a tension bolt 23, maintaining the stack of discs 19 and the end cap 22 together as in the industrial muffler described above.

As in the muffler configuration of FIGS. 1 and 2, the muffler 34 of FIG. 3 includes the same relationship between the end wall opening 47 and the high frequency inductor tubes 44: the area of that opening, for best high-frequency noise attenuation, is at least equal to the sum of the areas of the downstream ends 46 of the tubes 44. Theory behind the success of this relationship is presented above.

It has been found that a slight modification of the muffler construction shown in FIGS. 1, 2 and 3 can result in a dramatic and even further noise reduction. This modification involves the introduction of a multiplicity of small holes 45 in the divider plate 13 shown in the muffler of FIGS. 1 and 2 and the muffler of FIG. 3. For example, there may be approximately 24 holes 45, of approximately $\frac{1}{8}''$ diameter. A larger number of holes can be used, such as about 48 holes of 3/32" diameter, but the number of holes should not be significantly smaller than 24, with significantly larger diameter. For example, six holes of $\frac{1}{4}''$ diameter would reduce the beneficial result desired, even though the cross section area of the holes in all of the above examples is the same [1% of the area of the divider plate 13].

The holes 45 provide a Helmholtz resonating interface between the spark arrestor chamber 18 and the chamber 37, in the embodiment of FIG. 3, or between the spark arrestor chamber 18 and the chamber 14 in the embodiment of FIGS. 1 and 2.

The open cross sectional area of the holes 45, collectively, is generally between $\frac{3}{4}$% and $1\frac{1}{2}$% of the area of the divider plate 13.

The principal benefit provided by the holes 45 occurs in attenuating the high frequencies that continue to exist when a given muffler design is used on engines of a number of different displacements. For example, a muffler constructed in accordance with FIG. 3, but without the holes 45, designed for a motorcycle with a fairly large displacement engine was tested on a small engine, of only 200 cc displacement. Overall noise was less than possible with conventional prior art mufflers, but only slightly less. Analysis shows that the higher frequencies did not drop off as much as expected. It was then found that the introduction of the holes 45 in the distribution discussed above had the effect of reducing the higher frequencies by almost 6 dB, or about one half the noise level.

When the modified muffler 34, including the holes 45, was again used on the larger displacement engine, a 2 dB drop in noise resulted as compared to the muffler 34 without the holes 45.

The beneficial effect of the holes 45, when used in combination with the relationship described above among the tube ends 46, the plate 13 and the end wall 48, seens nearly universal in effect, though the effect is most pronounced where the existing low frequency component is less, i.e. in small displacement engines.

FIGS. 4–7 show another embodiment of a resonator type muffler 50 according to the invention. It comprises an outer shell or megaphone 51 (broken lines in FIGS. 4 and 5), the upstream part of which is not shown, a chamber divider plate 52 partioning the interior space into first and second resonator chambers 53 and 54, a pair of upstream or primary inductor tubes 56, and a downstream or secondary inductor tube 57 connected to pass the exhaust through an end wall plate 58. There may also be a spark arrestor 59 similar to those of the mufflers described above, comprising an end cap 22 and a series of cup-shaped annular discs 19, all retained by a bolt 61 as shown.

Figure 4:
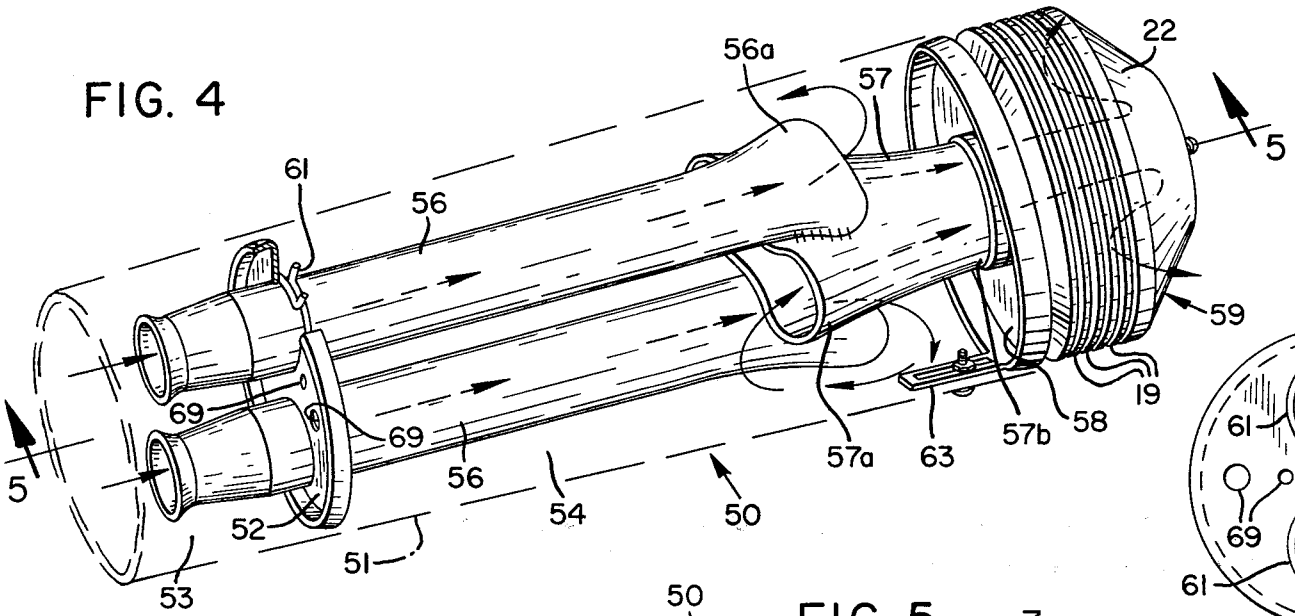
FIG. 4 is a perspective view showing the inside components of another embodiment of a muffler according the the invention, with a portion of the muffler shell or megaphone shown in broken lines.
Figure 5:
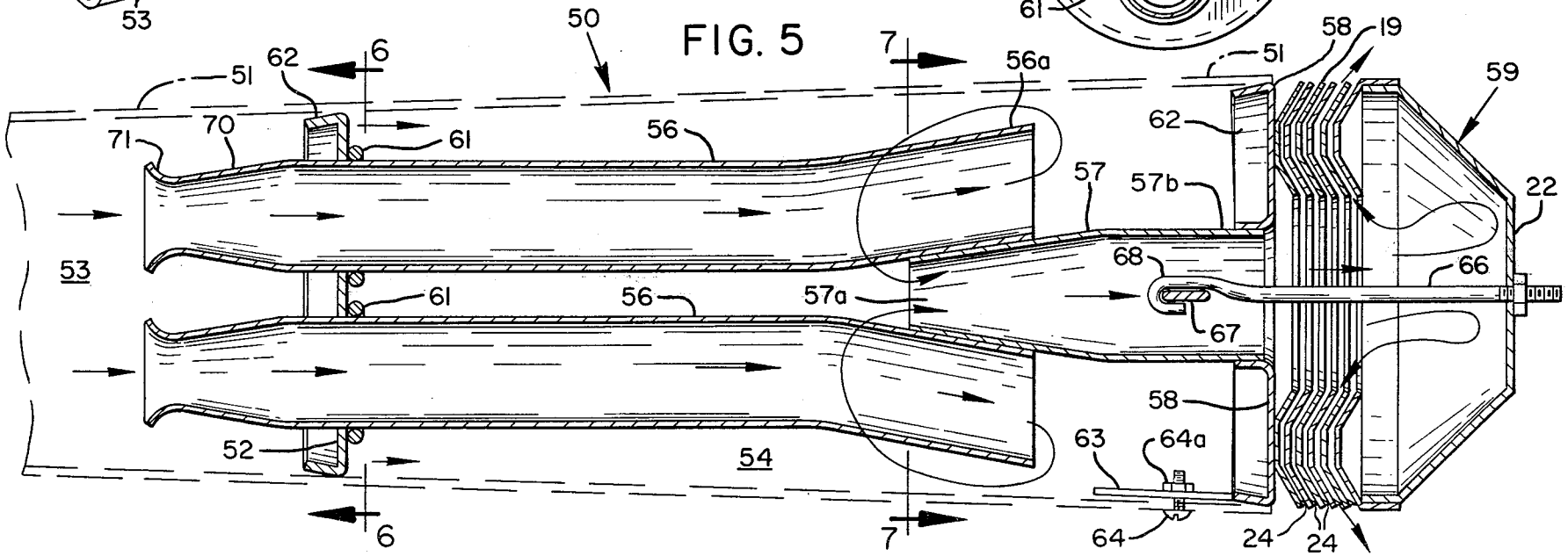
FIG. 5 is a longitudinal sectional view of the muffler of FIG. 4.

In this embodiment of a muffler, the configuration of the inductor tubes 56 and 57, and the assembly of the various components into the muffler shell 54 are particularly important, because the components are adapted to act as a replacement "core" for a wide variety of existing mufflers, by insertion of these components into the tapered muffler shell 51. This is facilitated in part by the partial flattening of the overlapping ends **56*a* and 57*a* of the primary and secondary inductor tubes 56 and 57, respectively. The ends 56*a* of the two primary tubes 56 are widely flared, for reasons discussed in connection with the previous embodiments, so that when they are partially flattened into the secondary tube 57 as shown in FIGS. 4 and 5**, they still provide an adequate end flare, or flow diffuser.

The downstream tube 57 preferably is flattened or squashed down to a greater extent than the primary tubes 56, as shown in the drawings, to accommodate the tubes 56 closely and compactly. At the same time, the downstream tube 57 in effect tapers from a smaller area at its upstream end **57*a* to a larger area at its downstream end 57*b*. The primary and secondary tubes 56 and 57** are rigidly secured together, as by welding.

The chamber divider 52 is tightly fitted over the cylindrical primary tubes 56, but not welded or otherwise secured to the tubes, so that it can be moved forwardly or backwardly on the tubes with some degree of force. Aiding in the connection are a pair of heavy spring clamps 61 which have the effect of holding the chamber divider at an upstream position on the tubes 56 except when considerable force is applied, whereupon the spring clamps will slip down the tubes along with the chamber divider 52.

As indicated in the drawings, both the chamber divider plate 52 and the end plate or end wall 58 of the muffler have upstream-oriented flanges 62 which taper slightly to a narrower diameter in the upstream direction. The end wall 58 is affixed to the downstream end **57*b* of the secondary tube 57, preferably by welding, so that it is rigid with the tube assembly. When this assembly, with the chamber divider plate 52 attached and positioned at a far upstream location initially, is inserted into a tapered megaphone or muffler shell 52 and pushed into the shell, the divider plate 52 will first wedge against the interior of the muffler shell and stop the upstream movement. At that point is is usually required that the assembly be driven the remaining distance into the muffler shell, causing the divider plate 52 to wedge more tightly against the shell and the tubes 56 to slide with respect to the divider plate 52 and the spring clamp 61. The tubes are driven in until the end wall plate 58 (of a larger diameter than the divider plate 52) wedges against the interior of the shell 51 as shown in FIG. 5. This most desirably occurs at the position shown in FIG. 5** or slightly farther upstream.

Once the "core" has been assembled into the muffler shell 51, the end plate 58 may be retained to the downstream end of the shell by a slotted bracket 63 extending in the upstream direction from the flange 62 of the end plate 58. One or more of the slotted brackets 63 may be provided. A hole is formed (not seen in the drawings) in the muffler shell for a bolt 64 or similar fastener. The slotted bracket 63 is sufficiently long that the bolt 64 can be installed, loosely, before the end plate 58 reaches the end of the muffler shell 51. When the end plate is finally in position, the fastener 64 can be tightened from the outside, there being appropriate means for holding the nut **64*a***, within the muffler, from turning.

Figure 7:
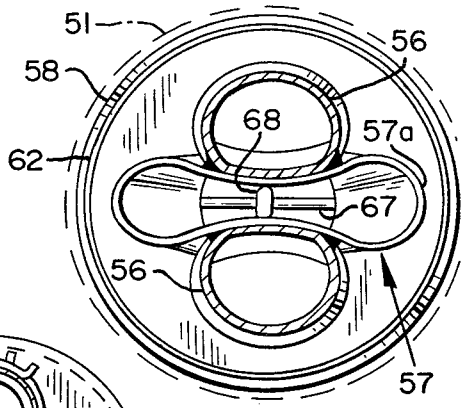
FIG. 7 is a sectional view taken along the lines 7—7 of FIG. 5.

The spark arrestor 59 preferably is secured to the remainder of the muffler 50 after the "core" has been assembled into place within the shell 51. This assembly may be via a bolt 66, as in the previously described forms of mufflers, except that the bolt 66 is not secured to an end wall, but rather to a transverse anchor 67 across the interior of the secondary inductor tube 57, as shown in FIGS. 5 and 7. The bolt 56 may be rigidly secured to the anchor 67, or it may have a hook end 68 as shown, simply hooked around the anchor 67 and retained there by the tension in the bolt 66 after the assembly is complete.

As illustrated and described, the muffler 50 of FIGS. 4 through 7 includes two upstream or primary inductor tubes 56 and a single downstream or secondary tube 57, and this arrangement is preferred. However, a single upstream tube could be included, with one, two or more downstream tubes if desired (not shown). Of course, the exhaust flow from the downstream tubes would have to be funneled centrally, if the type of spark arrestor 59 shown in the drawings were still to be used.

In operation, exhaust flow and noise energy travel downstream in the muffler shell 51, some entering the upstream ends of the inductor tubes 56 directly and some reflecting off the divider plate 52 and ultimately reaching the inductor tubes after reflection. The upstream ends of these tubes include tapers or flow diffusers 67 as in the earlier described embodiments, and preferably also bell mouthed ends 68 as shown, for reasons described above. As the gases exit the downstream ends **56*a* of the tubes, the direction of flow is reversed (shown by arrows in FIGS. 4 and 5), and ultimately directed into the upstream end 57*a* of the secondary inductor tube 57. From there the gases exit into the spark arrestor 59, as indicated, where the direction of flow is again reversed and sparks and hot particles are collected in the end cap 22. The gases ultimately are exhausted from the spaces among the series of stacked discs 19**.

Noise is attenuated to a large extent within the primary inductor tubes 66, where partial reflections at both the upstream and downstream ends create a cancellation phenomenom similar in most respects to that described above for the other forms of mufflers of the invention. The desired inductance effect is achieved primarily by the length of the primary inductor tube 56, most effective on the lower frequency ranges of noise. The secondary inductor tube 57 also attenuates noise, primarily in the higher frequencies, it being a shorter tube. The spark arrestor 59 actually serves as a third chamber in resonance with the second chamber 54, with the secondary tube 57 between them. The tapering cross section of the downstream tube 57 preferably has an effective diffusion rate of 15° or less.

A portion of the acoustical energy exiting the secondary inductor tube 57 reflects off the end cap 22 of the spark arrestor, and this reflected energy can easily return back through the core configuration of the muffler 50 for further energy dissipation. This is particularly true of the higher frequencies where the non-linear characteristics of the acoustical energy encourage the dissipation of the higher frequencies. The overall configuration of this muffler, as well as those described above, discourages acoustic reflection in the downstream direction by making the acoustical window (i.e., the open cross section exposed to impinging noise waves) as small as possible when viewed in the downstream direction, which is the undesirable direction of noise flow. Small passages and tapered inlets accomplish this. However, the small passages are always followed by a diffuser which both recovers the flow kinetic energy of the gas, thereby reducing back pressure, and also provides a large acoustical window when viewed in the upstream direction, promoting the movement of sound waves back up the exhaust system rather than into the atmosphere.

Inductor tube resonating mufflers unusually have a frequency range or region in which their noise attenuating ability is substantially reduced. Precise analysis and prediction of where and to what extent this reduction of attenuation will occur is almost impossible because of the superimposed air and gas stream, which has an enormous and complex effect on the results. The muffler configuration shown in FIGS. 4–7, when used for a multi-cylinder motorcycle, reveals a reduced attenuation over a 400 rpm region at 3000 rpm, 6000 rpm, 9000 rpm, etc. A solution to this problem was to introduce a side branch resonator by providing small holes 69 in the divider plate 52. Because of the small size of the holes, they have little effect on the attenuating ability of the muffler where the normal attenuating effects are dominent. However, in the frequency ranges where reduced attenuation exists, the volume of the second chamber 54, together with the size of the holes 69, provides in effect a side branch resonator with respect to the first chamber, and vice versa. A side branch resonator typically has a narrow frequency range in which it is extraordinarily effective in attenuating sound. The side branch resonator holes 69 were found to be sufficient to provide almost complete noise attenuation at the frequency ranges not significantly attenuated by the remainder of the system.

Although much of the criteria for effective noise attenuation in the forms of mufflers shown and described above have been determined empirically, with much of the theory not well understood, there are certain guidelines which can be applied to the various dimensions and volumes concerned. Thus, in general the length of each high frequency inductor tube in the forms of mufflers shown in FIGS. 1, 2 and 3 should be approximately $\frac{1}{8}$ the wavelength of the predominant frequency to be attenuated. The same is true of the secondary inductor tube 57 in the embodiment of FIGS. 4–7. The primary inductor tube 42 in the muffler of FIG. 3, and the pair of primary inductor tubes 56 in the embodiments of FIGS. 4–7, should have a length of approximately $\frac{1}{4}$ the wavelength of the predominant frequency to be attenuated by those tubes, i.e. the lower frequencies.

The primary resonating chamber 36 of the muffler shown in FIG. 3, as well as the first chamber 53 of the muffler of FIGS. 4–7, should have a volume of at least about five times the displacement of one cylinder of the internal combustion engine with which the muffler is to be used. In each case, the next downstream chamber may be of approximately the same size.

In the muffler of FIGS. 4–7, the cross sectional area change of the secondary inductor tube 57, between the upstream end 57*a* and the downstream end 57*b*, is preferably a factor of approximately two.

The above described preferred embodiments provide mufflers for various applications, capable of a high degree of noise attenuation with very little back pressure, while being quite simple in construction. Important dimensional relationships and arrangements of components are responsible for these unexpectedly superior results. In one form of muffler, a versatile replacement core can be used in almost any existing tapered muffler shell to improve the performance of the muffler. Various other embodiments and alterations to these preferred embodiments will be apparent to those skilled in the art and may be made without departing from the spirit and scope of the invention as defined in the following claims.

I claim:

1. A resonator type muffler for an internal combustion engine, comprising:

an elongated housing having an inlet and an outlet;

a chamber divider extending generally transversely across the interior of the housing to define a first chamber in communication with the housing's inlet, upstream of the divider, and a second chamber downstream of the divider;

at least one sound inductor tube extending longitudinally in the housing through the chamber divider, with an inlet end in the first chamber and an outlet extending into the second chamber; and a wall forming a downstream end of the second chamber, with an opening;

the outlet end of the inductor tube being spaced from the wall at the downstream end of the second chamber by a distance of from about $\frac{1}{2}$ to 1 inch, and being offset from the wall opening.

2. The resonator type muffler of claim 1, including at least two similar inductor tubes arranged coextensively.

3. The resonator type muffler of claim 1, wherein said distance is about $\frac{3}{4}$ inch.

4. The resonator type muffler of claim 1, 2 or 3 wherein the area of the opening in the downstream end wall of the second chamber is at least equal to the sum of the areas of each inductor tube.

5. The resonator type muffler of claim 1, further including means defining a third chamber downstream of the wall at the end of the second chamber, in communication with the inductor tube, with an outlet connecting the third chamber to the atmosphere.

6. The resonator type muffler of claim 5, further including spark arrestor means associated with the third chamber, for collecting hot particles from the exhaust stream and preventing their passage out to the atmosphere.

7. The resonator type muffler of claim 1, wherein the housing is tapered from a smaller end at its inlet to a larger end at its outlet.

8. The resonator type muffler of claim 1, wherein the chamber divider is a plate of the same shape as the cross-sectional shape of the housing, with an opening for each inductor tube, fitted closely around the tube in substantial sealing relationship.

9. The resonator type muffler of claim 1, wherein each inductor tube includes flow diffuser means at its outlet end for reducing flow resistance where high-velocity gases in the inductor tube decelerate into the second chamber.

10. The resonator type muffler of claim 9, said flow diffuser means comprising a flare or taper at the downstream end of each inductor tube, extending to a larger opening area at the outlet end.

11. The resonator type muffler of claim 1, wherein each inductor tube includes a taper at its upstream end, the inlet to the tube being of smaller opening area and increasing as the taper progresses downstream, for enhancing reflected sound wave attenuation.

12. The resonator type muffler of claim 11, further including a bell mouth at the upstream end of the inductor tube taper, for efficiently receiving gases and sound energy in the tube.

13. The resonator type muffler of claim 1 or 2, wherein each inductor tube extends through the chamber divider into the second chamber by about $\frac{1}{4}$ inch, the chamber divider being about 1 inch from the downstream end wall of the second chamber.

14. The resonator type muffler of claim 13, wherein the area of the opening in the downstream end wall of the second chamber is at least equal to the sum of the areas of each inductor tube.

15. The resonator type muffler of claim 1, wherein the first chamber is immediately adjacent to the inlet.

16. The resonator type muffler of claim 15, the inlet being generally centrally located in the upstream end of the housing, with an axis of the housing passing through the inlet, and there being at least two inductor tubes arranged coextensively, generally parallel to the axis and spaced outwardly therefrom, out of the entry path from the inlet, with inlet ends of the inductor tubes extending adjacent to the inlet end of the housing.

17. The resonator type muffler of claim 16, wherein the opening in the downstream end wall of the second chamber is located along the axis of the housing.

18. The resonator type muffler of claim 17, the area of the opening in the downstream end wall of the second chamber being at least equal to the sum of the areas of the inductor tubes.

19. The resonator type muffler of claim 1, further including a primary chamber in the housing upstream of the first chamber and immediately adjacent to the inlet, with a primary chamber divider extending across the housing's interior between the primary and first chambers, and including a primary inductor tube extending longitudinally in the housing through the primary chamber divider, overlapping a portion of the length of each said sound inductor tube in the first chamber.

20. The resonator type muffler of claim 19, there being at least two said sound inductor tubes arranged coextensively, with their upstream portions juxtaposed with the downstream portion of the primary inductor tubes.

21. The resonator type muffler of claim 20, the area of the opening in the downstream end of the second chamber being at least equal to the sum of the areas of said sound inductor tubes.

22. The resonator type muffler of claim 19, the primary inductor tube being longer than said sound inductor tube and effective for lower frequencies.

23. The resonator type muffler of claim 19, further including means defining a third chamber downstream of the wall at the end of the second chamber, in communication with said sound inductor tube, with an outlet connecting the third chamber to the atmosphere.

24. The resonator type muffler of claim 23, further including spark arrestor means associated with the third chamber, for collecting hot particles from the exhaust stream and preventing their passage out to the atmosphere.

25. The resonator type muffler of claim 19, wherein the housing is tapered from a smaller end at its inlet to a larger end at its outlet.

26. The resonator type muffler of claim 19, wherein each inductor tube includes flow diffuser means at its outlet end for reducing flow resistance where high-velocity gases in the first inductor tube decelerate into the second chamber.

27. The resonator type muffler of claim 26, said flow diffuser means comprising a flare or taper at the downstream end of each inductor tube, extending to a larger opening area at the outlet end.

28. The resonator type muffler of claim 19, wherein said distance is about $\frac{3}{4}$ inch.

29. The resonator type muffler of claims 1, 19 or 20, wherein the length of each said sound inductor tube is about one-eighth the wavelength of the predominant frequency to be attenuated.

30. The resonator type muffler of claim 27, each said sound inductor tube having an effective diffusion rate of between about 10° and about 15°.

31. The resonator type muffler of claim 19, wherein the primary inductor tube has a length of about one-fourth the wavelength of the predominant frequency to be attenuated.

32. The resonator type muffler of claim 19, wherein the primary chamber has a volume of at least about five times the displacement of a cylinder of the engine.

33. The resonator type muffler of claim 32, wherein the first chamber is of about the same volume as the primary chamber.

34. The apparatus of claim 1, wherein the chamber divider includes a multiplicity of holes comprising about 1% of the area of the chamber divider.

35. The apparatus of claim 34, wherein said holes are between about 1/16" and 3/16" in diameter.

36. The apparatus of claim 2, 3, 5, 6, 8, 9, or 10, wherein the chamber divider includes a multiplicity of small holes.

37. A resonator type muffler for an internal combustion engine, comprising:

an elongated housing having an inlet and an outlet;

a chamber divider extending generally transversely across the interior of the housing to define a first chamber in communication with the housing's inlet, upstream of the divider, and a second chamber downstream of the divider;

at least one sound inductor tube extending longitudinally in the housing through the chamber divider, with an outlet end in the first chamber and an outlet extending into the second chamber; and a wall forming a downstream end of the second chamber, with an opening;

the outlet end of the inductor tube being spaced from the wall at the downstream end of the second chamber by a distance of about $\frac{3}{4}$ inch, and being offset from the wall opening, and the chamber divider including a multiplicity of small holes.

38. The resonator type muffler of claim 37, wherein said holes occupy about 1% of the area of the chamber divider.

* * * * *